US009068332B2

(12) United States Patent
Pace

(10) Patent No.: US 9,068,332 B2
(45) Date of Patent: Jun. 30, 2015

(54) RETRACTABLE BIDET DEVICE ACTUATED BY SINGLE MECHANISM WITH DELAYED FLOW

(76) Inventor: Edgar Alan Pace, Pinnacle, NC (US)

( * ) Notice: Subject to any disclaimer, the term of this patent is extended or adjusted under 35 U.S.C. 154(b) by 445 days.

(21) Appl. No.: 13/443,925

(22) Filed: Apr. 11, 2012

(65) Prior Publication Data

US 2013/0269094 A1 Oct. 17, 2013

(51) Int. Cl.
*A47K 3/20* (2006.01)
*E03D 9/08* (2006.01)

(52) U.S. Cl.
CPC ..... *E03D 9/08* (2013.01)

(58) Field of Classification Search
CPC ..... E03D 9/08; A61H 33/60; A61H 35/00; F16K 31/58; F16K 51/00; A47K 3/26
USPC ..... 137/616, 616.7; 251/77, 350, 352, 354
See application file for complete search history.

(56) References Cited

U.S. PATENT DOCUMENTS 1,521,892 A * 1/1925 Koppin ..... 4/420.4
4,275,754 A * 6/1981 Lyons et al. ..... 137/75
4,642,820 A * 2/1987 Boring, Jr. ..... 4/420.4
4,953,238 A * 9/1990 Shifferly ..... 4/420.2
5,331,692 A * 7/1994 Alberti ..... 4/445
5,384,919 A * 1/1995 Smith ..... 4/448
6,105,179 A * 8/2000 Burns ..... 4/420.4
7,318,242 B2 * 1/2008 Pace ..... 4/420.4
8,261,377 B2 * 9/2012 Oh ..... 4/420.5

* cited by examiner

*Primary Examiner* — Lauren Crane
*Assistant Examiner* — Erin Deery
(74) *Attorney, Agent, or Firm* — Robert W. Pitts

(57) ABSTRACT

This invention comprises a bidet device, including a bidet kit, that can be mounted on a conventional toilet seat. A bidet valve is positioned between a bidet hoop conduit and a water supply conduit. Rotation of the bidet hoop conduit results in rotation of a valve seat relative to a valve stem to permit water to flow through the bidet hoop conduit. Water does not initially flow and only flows as the bidet hoop conduit reaches an extended operative position. Rotation of a handle or lever arm is the only movement necessary to move the bidet hoop conduit and initiate actuation of the valve. The bidet valve includes an actuator with a notch, the sides of which engage a stationary arm attached to the toilet seat to open and close the valve.

16 Claims, 8 Drawing Sheets

RETRACTABLE BIDET DEVICE ACTUATED BY SINGLE MECHANISM WITH DELAYED FLOW

BACKGROUND OF THE INVENTION

1. Field of the Invention

This invention relates to bidet fixtures and kits for use on a standard toilet for dispensing a flow of water on areas of a user's posterior, such as anal and genital regions, to promote cleaning without unduly wetting the person or portions of the toilet or bathroom which would otherwise require additional cleanup.

2. Description of the Prior Art

U.S. Pat. No. 7,318,242 discloses a bidet device in which a single lever or handle can be manipulated to both move a bidet conduit and nozzle to an operative position and to start and stop the flow of water through that bidet device. In that prior art device, a bidet valve is connected to a rotatable bidet hoop conduit. The bidet hoop conduit in that prior art device is moved from a retracted position adjacent the underside of a toilet seat to an extended operative position in which the bidet hoop conduit extends downward, away from the toilet seat. In the operative position a nozzle on the bidet hoop conduit is centrally positioned below the center of the toilet seat in the fully extended position. One disadvantage of this prior art device is that the valve begins to open as soon as the bidet hoop conduit moves from the retracted position toward the extended operative position, and the valve begins to close as soon as the bidet hoop conduit starts to move toward the retracted position. This mechanism poses at least two problems. First the initiation of flow before the nozzle reaches its operative position tends to result is water being sprayed or broadcast to areas other than those where the cleansing action of water is most effective and most desirable. For example, water can be sprayed over the user's buttocks and water, which serves no purpose, must be dried and remove after use. Secondly the intensity of the spray varies in response to the extent of movement of the bidet hoop conduit. Thus, it is not possible for the user to move the water spray by moving the nozzle from the fully extended position without a consequent reduction in the intensity of the flow. The degree of rotation and opening of the valve is directly a function of the degree of rotation of the bidet hoop conduit in this prior art device. It would be desirable if the simple rotation of the bidet hoop conduit by a handle or lever arm would permit a variation of the flow in a manner other than a progressive function of the rotary position. For example it would be desirable if the flow of water would not be initiated until the nozzle approaches the extended operative position. It would also be desirable for the intensity of the flow, once initiated as the nozzle approaches the fully extended position, would remain substantially constant until the bidet device and the nozzle were returned to the retracted position.

It is possible to regulate flow independently of the position of a rotatable bidet hoop conduit and nozzle. For example, it is possible to employ two separate mechanisms for these two operations, or if one mechanism is employed, that one mechanism may require complicated, compound or multiple movements to perform the two operations. For example a handle on one side of a toilet seat could move the bidet conduit between retracted and extended, operative positions, while a valve lever on the other side of the toilet seat could independently open and close a bidet valve. One example of a bidet device with separate controls includes a handle for rotating a bidet conduit and a nozzle on the end thereof between retracted and operative positions. A push button on the handle can then be pressed by the thumb or finger to open a valve, or the push button could be released to close the valve and shut off water supply to the nozzle. Such a device requiring two different operative mechanisms poses problems for many individuals who would otherwise wish to employ a bidet device. Some individuals do not possess the strength or dexterity to manipulate two different controls. This is especially true for handicapped individuals or for the elderly, who would perhaps benefit the most from the use of a bidet device of this basic type. If a bidet device could be easily operated by residents of assisted living facilities, rest or retirement homes, nursing homes or hospitals, the standard of care could be improved.

SUMMARY OF THE INVENTION

The instant invention comprises a bidet device or bidet kit that can be used with or mounted to a conventional toilet seat. Both the position of the bidet conduit through which water flows and the flow of water through the bidet conduit can be controlled by one mechanism. This mechanism can comprise a handle or a lever arm and simple rotation of this mechanism, without any compound movements is sufficient to control the direction of flow, the initiation of flow and the extension and retraction of the bidet device relative to the toilet seat on which it is mounted. A user needs to use only one hand, and this bidet device is suitable for use by a person who lacks normal dexterity, such as a handicapped or elderly person. Flow through this device is only started when the nozzle on the bidet conduit reaches its operative position, so that water will not be broadcast over the user's posterior, and flow can be confined to areas when the cleaning action of the water is most appropriate and is most needed.

According to one aspect of this invention, this bidet device can be attached to a toilet seat. The bidet device includes a valve that can be connected to a water supply conduit and to a bidet hoop conduit. Rotation of the bidet hoop conduit opens the valve to supply water through the bidet hoop conduit. A nozzle is located on the bidet hoop conduit. An exposed, manipulatable portion of the bidet hoop conduit, such as a handle or lever arm, extends beyond on an opposite end of the toilet seat from the valve. Movement of the exposed, manipulatable mechanism moves the bidet hoop conduit from a retracted to an operative position in which the nozzle is positioned at a central location, spaced from the toilet seat. A stationary arm can be attached to the toilet seat beside the valve. The bidet device includes an actuator on the valve. Engagement of the actuator with the stationary arm opens the valve. The actuator has an arcuate notch through which the stationary arm extends. The actuator is initially rotatable with the bidet hoop conduit and engages the stationary arm as the bidet hoop conduit approaches the operative position to initiate water flow through the bidet hoop conduit and the nozzle only when the nozzle approaches the operative position.

According to another aspect of this invention, a bidet device can be moved to an operative position and flow of water through the bidet device can be activated by movement of a single operable member moveable by one appendage and in which initial water flow through the bidet device occurs only as the bidet device approaches the operative position. The bidet device includes a bidet hoop conduit movable from a retracted position below a toilet seat to the operative position spaced from and centered relative to the toilet seat. A valve is mounted on the bidet hoop conduit. The valve is opened by rotation of a valve actuator, the valve actuator being initially rotatable only as the bidet hoop conduit approaches the operative position.

According to still another aspect of this invention, the bidet device can be mounted on a toilet, the bidet device and includes a toilet seat mountable on the toilet. A bidet hoop conduit is mounted on an underside of the toilet seat. A bidet valve is mounted on one end of the bidet hoop conduit. An operable member, such as a handle, lever arm or strap, is located on an opposite end of the bidet hoop conduit. The bidet hoop conduit can be rotated from a retracted position to an operative position by movement of the operable member. The bidet is shifted from a closed position to an open position only after the bidet hoop conduit approaches the operative position, and is shifted from the open to the closed position as the bidet hoop conduit approaches the retracted position.

BRIEF DESCRIPTION OF THE DRAWINGS

FIG. 5A shows the bidet hoop conduit as it moves from the retracted position to the operative position before the bidet valve is opened.

FIG. 5B shows the hoop conduit and the nozzle in the operative position in which flow is directed upward. FIG. 5C shows flow through the nozzle as the bidet hoop conduit is withdrawn from the fully operative position but prior to its return to the retracted position.

DETAILED DESCRIPTION OF THE PREFERRED EMBODIMENT

Figure 1:
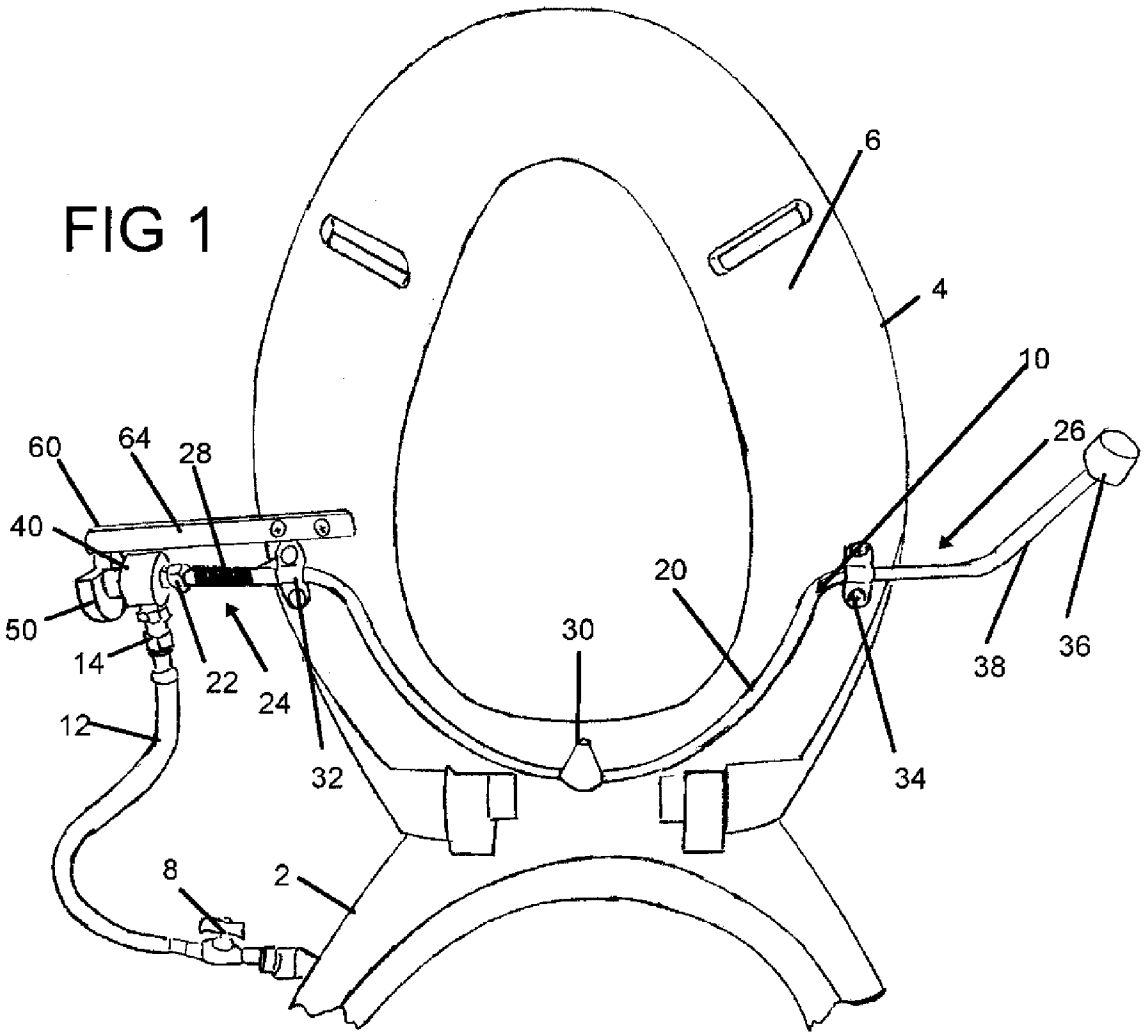
FIG. 1 is a view of a bidet valve assembly or kit mounted to a toilet seat, with the bidet valve assembly in a retracted position in which the bidet hoop conduit extends around a portion of the underside of the toilet seat.

The bidet device 10 according to the preferred embodiment of this invention is mountable to an otherwise conventional toilet seat 4 as shown in FIG. 1. Bidet device 10 includes a bidet hoop conduit 20 and a valve 40 mounted on a first end of the bidet hoop conduit 20. The valve 40 is located between the bidet hoop conduit 20 and a water supply conduit 12, which can comprise a conventional water line employed with a conventional toilet 2. The water supply conduit 12 extends from a conventional supply cutoff valve 8 of the type employed with a standard toilet 2. A water supply conduit coupling 14 connects the bidet valve 40 with the bidet hoop conduit 20. The bidet hoop conduit 20 has a curved, generally semi-circular, center section and the bidet hoop conduit 20 is mounted on the toilet seat underside 6 so that when the toilet seat is lowered from the upright, retracted position shown in FIG. 1, the bidet hoop conduit 20 will extend between the toilet seat 4 and the top rim of the standard toilet 2. The bidet valve 40 will be positioned beside the toilet seat 4 on a first side of the bidet hoop conduit 20. A handle 36 will be mounted on an opposite second end of the bidet hoop conduit 20, which will extend beyond an opposite second side of the toilet seat 24. A section of the bidet hoop conduit 20 extending from the second side of the toilet seat 3 to the handle 36 will comprise a lever arm 38, which will provide sufficient mechanical advantage to allow virtually any user of the bidet device 10 to rotate the bidet hoop conduit 20 from a retracted position, as shown in FIG. 1, to an extended or operative position in which the bidet hoop conduit 20 will extend into the bowl of toilet 2. The handle 36 and/or the lever arm 38 will comprise an exposed manipulatable or operable member that will serve as the only mechanism that is necessary to operate the bidet device 10 by both moving the bidet hoop conduit 20 between retracted and operative positions as well as opening and closing the bidet valve 40 to allow water to flow through the bidet hoop conduit. A nozzle 30 is located in the center of the curved section of the bidet hoop conduit 20, and the nozzle 30 will be generally centrally located between the two sides of the toilet seat 4 and generally centrally located in the opening of the toilet seat 4 when the bidet hoop conduit 20 is in the operative position in which its curved section extends away from the toilet seat underside 6.

The bidet hoop conduit 20 is mounted to the toilet seat underside 6 by mounting clips 32 and 34 on toilet seat segments on opposite sides of the central toilet seat opening.

FIG. 1 shows these clips 32 and 34 screwed into the toilet seat underside 6. Mounting clips 32 and 34 provide space for the bidet hoop conduit 20 to rotate relative to these clips 32 and 34 as the bidet hoop conduit 20 is rotated between its retracted and extended or operative positions. The mounting clips 32 and 34 allow the bidet device subassembly comprising the bidet hoop conduit 20 and the bidet valve 40 to be mounted on a conventional toilet seat 4 without the need for any other fastening components. After attachment of this bidet device subassembly to the toilet seat 4, this combined kit assembly can be mounted to a toilet 2 by attaching the toilet seat 4 in a conventional manner.

The bidet valve 40 is attached to the first end of the bidet hoop conduit 20 by a valve coupling 22. The bidet valve 40 includes a valve seat 42 or valve seat housing that is attached both to the water supply conduit 12 at valve inlet 46 on one side and to the bidet hoop conduit 20 through a valve outlet 48 at an outer end. The valve 40 also includes a valve stem 44 that is rotatable relative to the valve seat 42 to which it is threaded. When the valve stem 44 is rotated in a counterclockwise direction, relative to the valve seat 42, the valve stem moves away to open the valve 40 and to allow water to flow from the water supply conduit 12 to the bidet hoop conduit 20. Relative clockwise movement of the valve stem 44 relative to the valve seat 42 closes the valve.

Figure 2:
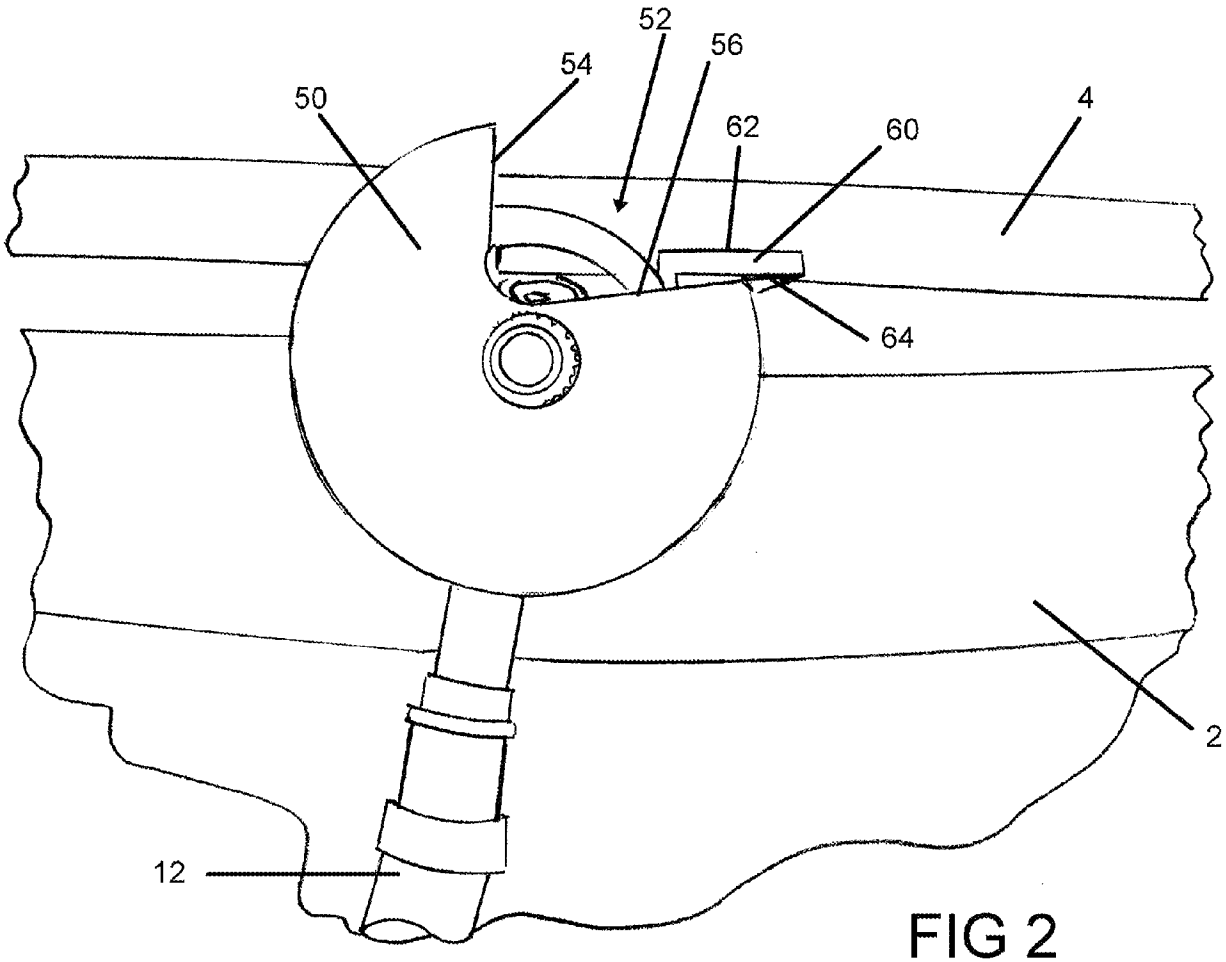
FIG. 2 shows an end view of an arcuate valve actuator as part of a valve subassembly, in which the valve actuator is attached to the valve stem, and in which the valve stem rotates relative to the valve seat as the valve actuator engages a stationary arm.

Rotation between the valve seat 42 and the valve stem 44 is imparted by rotation of the bidet hoop conduit 20, which rotates the valve seat 42. The water supply conduit 12 is flexible so that as the valve seat 42 rotates, the conduit 12 can also move and flex. In addition to the valve seat 42 and the valve stem 42, the bidet valve 40 also includes an arcuate valve actuator 50, which is attached to the valve stem 44 and a stationary arm or reaction member 60 which is fixed relative to the toilet seat 4. The valve actuator 50 in the preferred embodiment comprises a metal disk that is fixedly attached to an exposed end of the valve stem 44. As best seen in FIG. 2, arcuate valve actuator 50 has a notch 52, which in the preferred embodiment extends around approximately ninety degrees around the arc of the valve actuator 50 and relative to the valve stem axis. Radially extending first and second notch surfaces 54 and 56 extend at approximately ninety degrees relative to each other and the notch 52 is open between these two surfaces. The stationary member or arm 60 is located beside the bidet valve 40 and extends axially through notch 52. The valve stem 44 is free to rotate with the valve seat 42 until one of the notch surfaces 54 and 56 engage the stationary arm 60, at which point further rotation of the valve actuator 50 and the valve stem 44 stops, while the valve seat 42 continues to rotate with the bidet hoop conduit 20 so that the bidet valve 40 is either opened or closed, depending upon the direction of rotation of the bidet hoop conduit 20. FIG. 2 shows the notch surface 56 in engagement with the bottom surface 64 of the arm 60, the position occupied when the bidet device is in the operative position. In the retracted position shown in FIG. 1, the notch surface 54 would be in engagement with the top surface 62 of the stationary arm 60.

A coil spring 28 extends around the bidet hoop conduit 20 between the bidet valve coupling 22 and the first clip 32, which is secured to the toilet seat 4. One end of the spring 28 is attached to the clip 32 so that it will be fixed relative to the toilet seat4, and the other spring end is attached to the valve seat housing 42. Thus rotation of the bidet hoop conduit 20 and the valve seat 42 relative to the toilet seat 4 will stress the coil spring 28, and after the coil spring is stressed, release of the handle 30 and the bidet hoop conduit 20 by a user will cause the bidet hoop conduit 20 to rotate from an operative position back to the retracted position shown in FIG. 1. This action of the coil spring 28 will also result in closing the bidet valve 40, which would have been open in the operative position.

Figure 3:
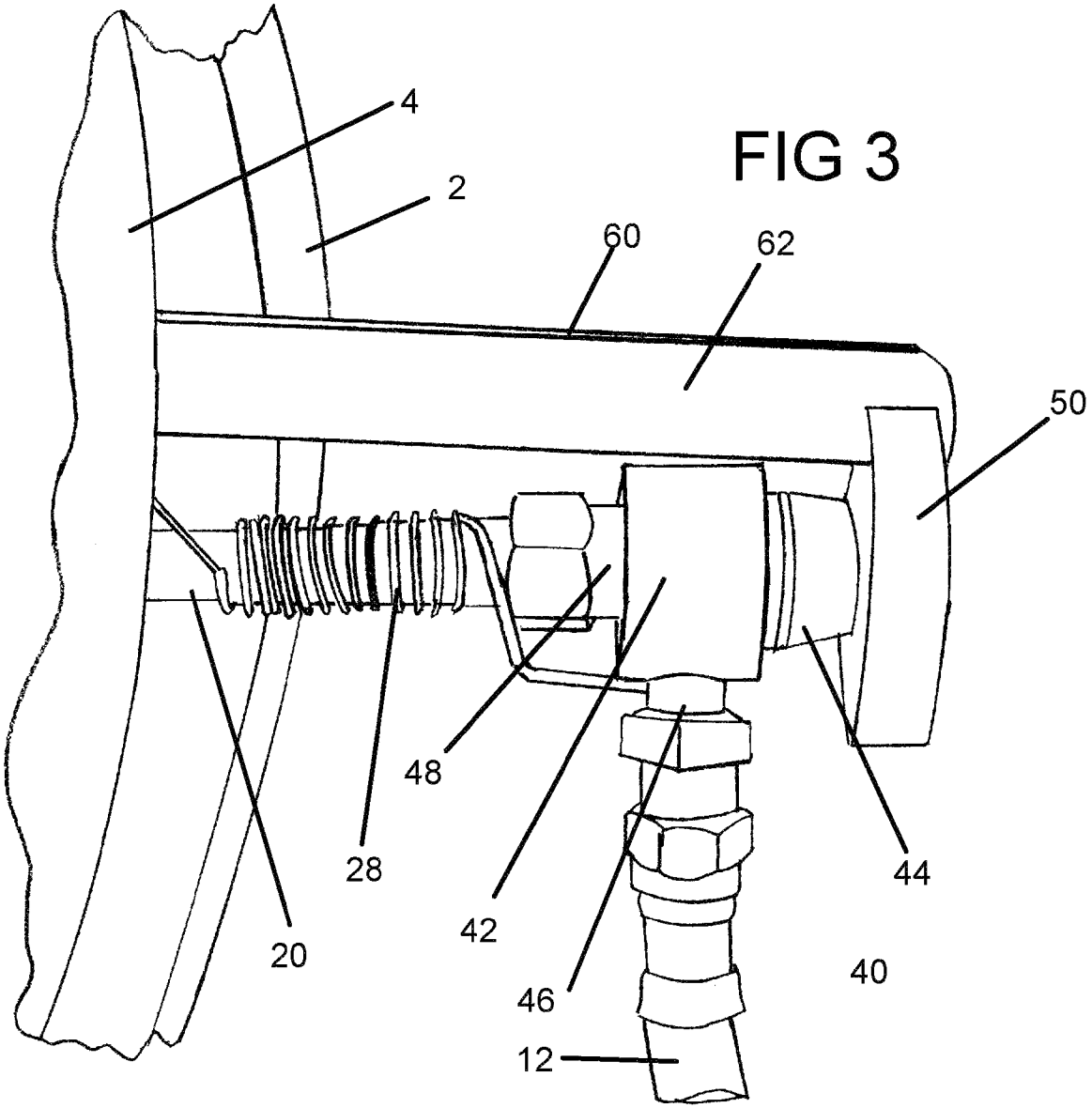
FIG. 3 is a top view of the valve subassembly with the valve in the position shown in FIG. 1 when the bidet device is in a retracted position.
Figure 4:
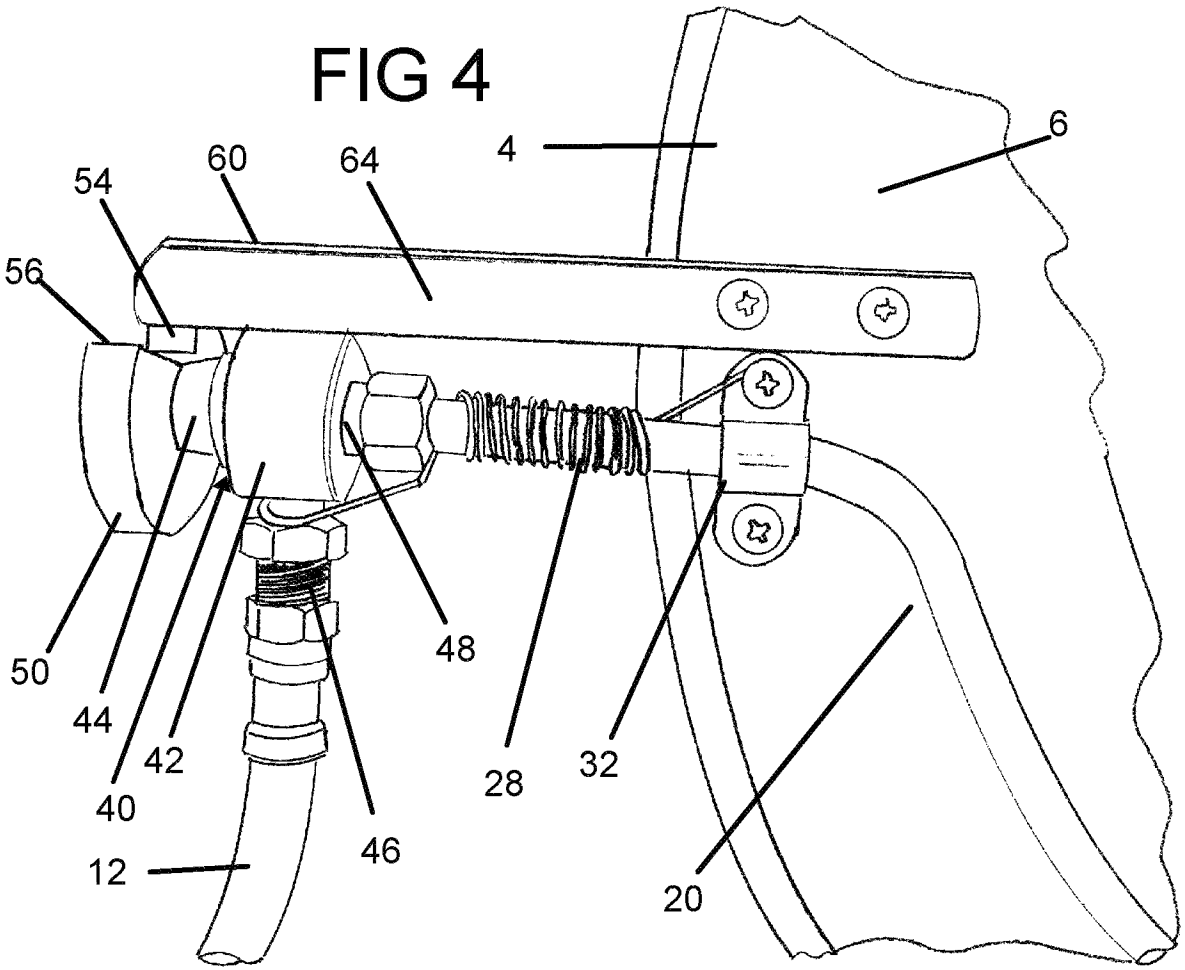
FIG. 4 is a bottom view of the valve subassembly in the position shown in FIG. 3.
Figure 5A:
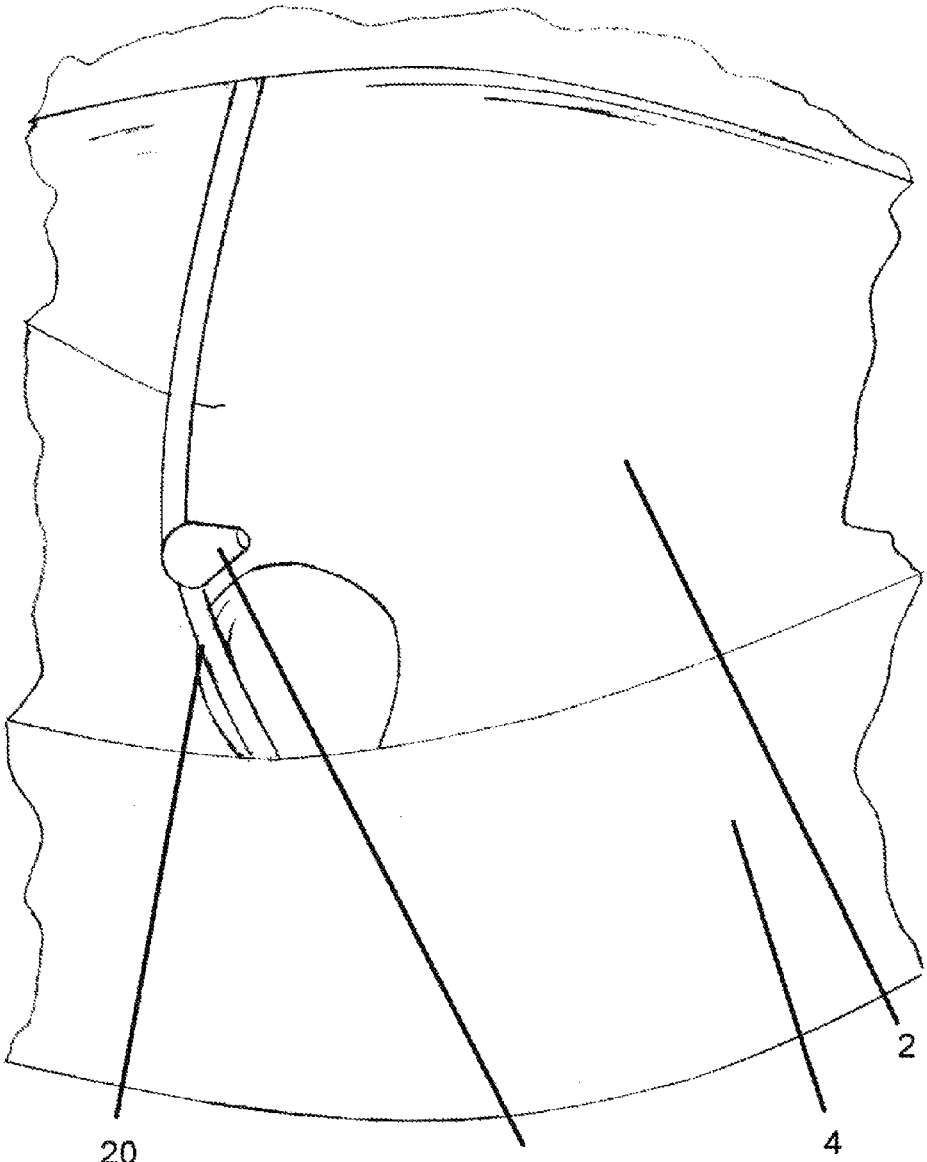
FIGS. 5A-5C demonstrate movement of the bidet hoop conduit and nozzle between the retracted and the operative positions.
Figure 5B:
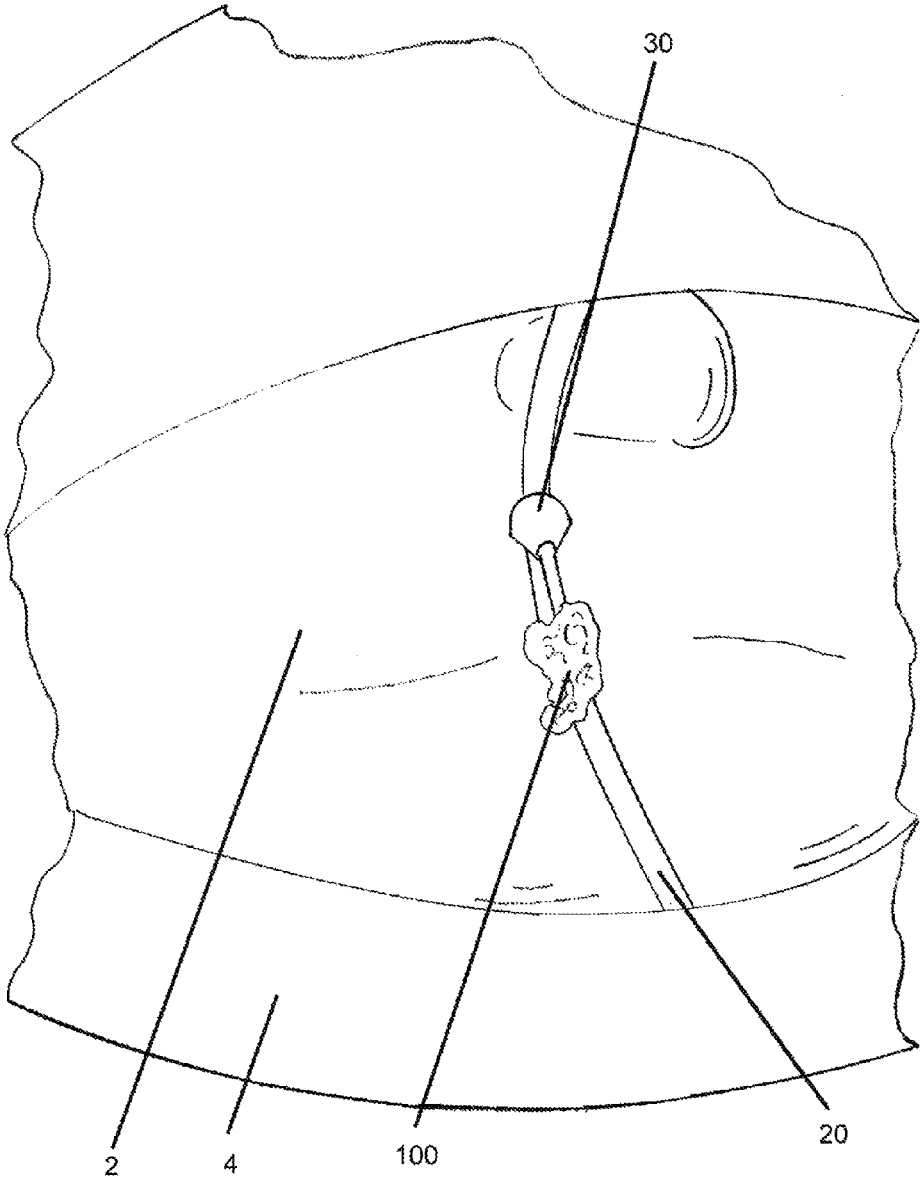
Figure 5C:
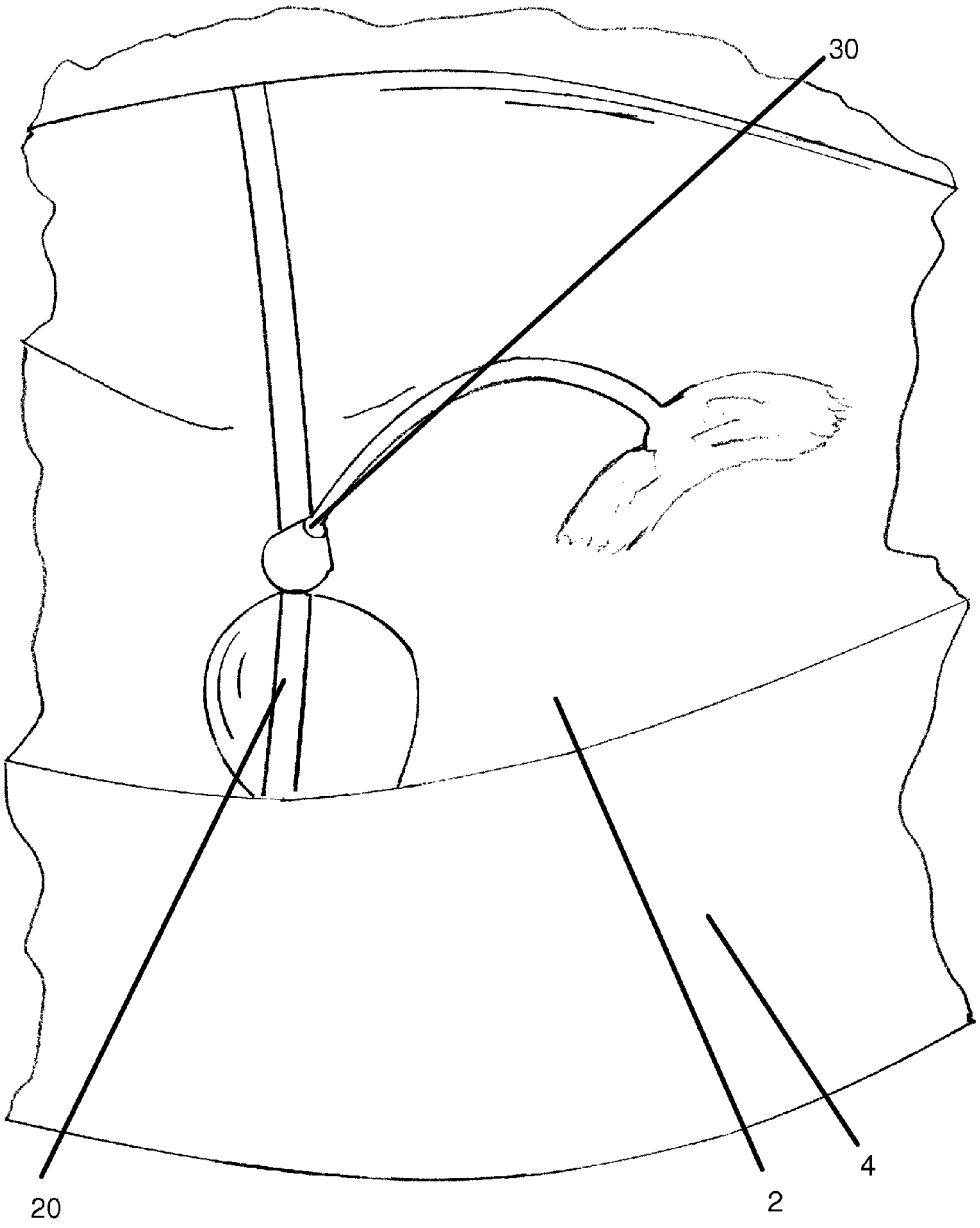

FIGS. 5A-5C show representative stages through which the bidet valve 40 operates as the bidet hoop conduit 20 is moved between the retracted and the operative positions. In the retracted position the notch surface 64 engages the top surface 62 of stationary arm 60, and the bidet valve 40 is therefore closed. When the bidet hoop conduit 20 is first rotated from the retracted position shown in FIGS. 1, 3 and 4, the valve stem 44 rotates with the vale seat 42 because there is no reaction force tending to impart relative rotation. Thus when the handle 36 and/or the lever arm 38 are first pulled upward from the retracted position, the valve actuator 50 does not engage the stationary arm 60, which still extends through the notch 52 without engaging notch surface 56. FIG. 5A shows that during this initial movement away from the retracted position, there is no flow through the nozzle 30. In the preferred embodiment the notch surface 54 extends substantially at a right angle relative to the notch surface 56. Thus when the handle 36 and lever arm 38 are rotated through and angle of approximately ninety degrees, the notch surface 56 will be brought into engagement with the lower surface 64 of the stationary arm 60, as shown in FIG. 2. This rotation of the actuator 50 will be imparted by rotation of the bidet hoop conduit 20, which is caused by continued upward movement of the handle 36 and lever arm 38. Thus when the bidet hoop conduit 20 reaches or approaches the operative position, the bidet valve 40 will open, as rotation of the valve stem 44 will be restricted, but the valve seat 42 will continue to rotate with continued rotation of the bidet hoop conduit 20 past the angle at which flow begins as the valve 40 starts to open, increasing the volume of flow through the valve 40 and nozzle 30. Clockwise rotation of the valve seat 42 relative to the valve stem 44 causes the valve stem 44 to move axially away from the valve sealing surface on the valve seat 42, thus opening the bidet valve 40. This action delays initial flow through the nozzle 30 until the nozzle either reaches or is close to the operative position, where it vertical separation of the nozzle 30 from the user approaches it greatest extent. In this position water will flow in a stream 100 that is essentially vertical as shown in FIG. 5B. This delay will limit undesirable wetting of the user's entire posterior, and will limit flow to the anal and/or genital areas where the cleansing action of the bidet is most desirable and effective. Although a ninety degree rotation is shown in this representative embodiment, it should be understood that the orientation of notch surfaces 54 and 56 need not be ninety degrees, and other orientations can be selected, especially if flow through the nozzle 30 is deemed desirable before the bidet hoop conduit 20 and the nozzle 30 reach the fully operative position. For example, it the angle between notch surfaces 54 and 56 is eighty degrees, then flow will start ten degrees before the nozzle 30 reaches a ninety degree position, and flow will increase from the initiation of flow at eighty degrees until the nozzle reaches the ninety degree position, which in some applications can be considered to be a fully operative position.

Water flow through nozzle 30 will not be shut off as the bidet hoop conduit 20 first rotates from the fully extended position shown in FIG. 5B toward the retracted position. FIG. 5C shows that the flow stream 100 continues, but is now directed and an angle and is tilted toward the front of the toilet seat 4. In order to direct flow in this manner, the user merely holds the handle 36 or lever arm 38 in a partially retracted position. Since the valve actuator 50 will then be disengaged from the stationary arm 60, there will be no reaction force tending to close the bidet valve 40 in this position. Continued flow during the initial closing stage will allow washing of the vaginal area when the bidet hoop conduit 20 is restrained and cannot fully close.

When the bidet hoop conduit 20 approaches the fully retracted position, the notch surface 54 will engage the top surface 62 of the stationary arm 60, causing relative rotation of the valve seat 42 relative to the valve stem 44 to close the bidet valve 40 and shut off flow through the nozzle 30. The coil spring 28 biases the bidet hoop conduit 20 toward the fully retracted position, so that if the use merely releases the handle 36 or lever arm 38, the bidet valve 40 will be quickly closed to quickly shut off continued flow of water through the nozzle 30 as the bidet hoop conduit 20 moves from the extended operative position to the retracted position.

Figure 6:
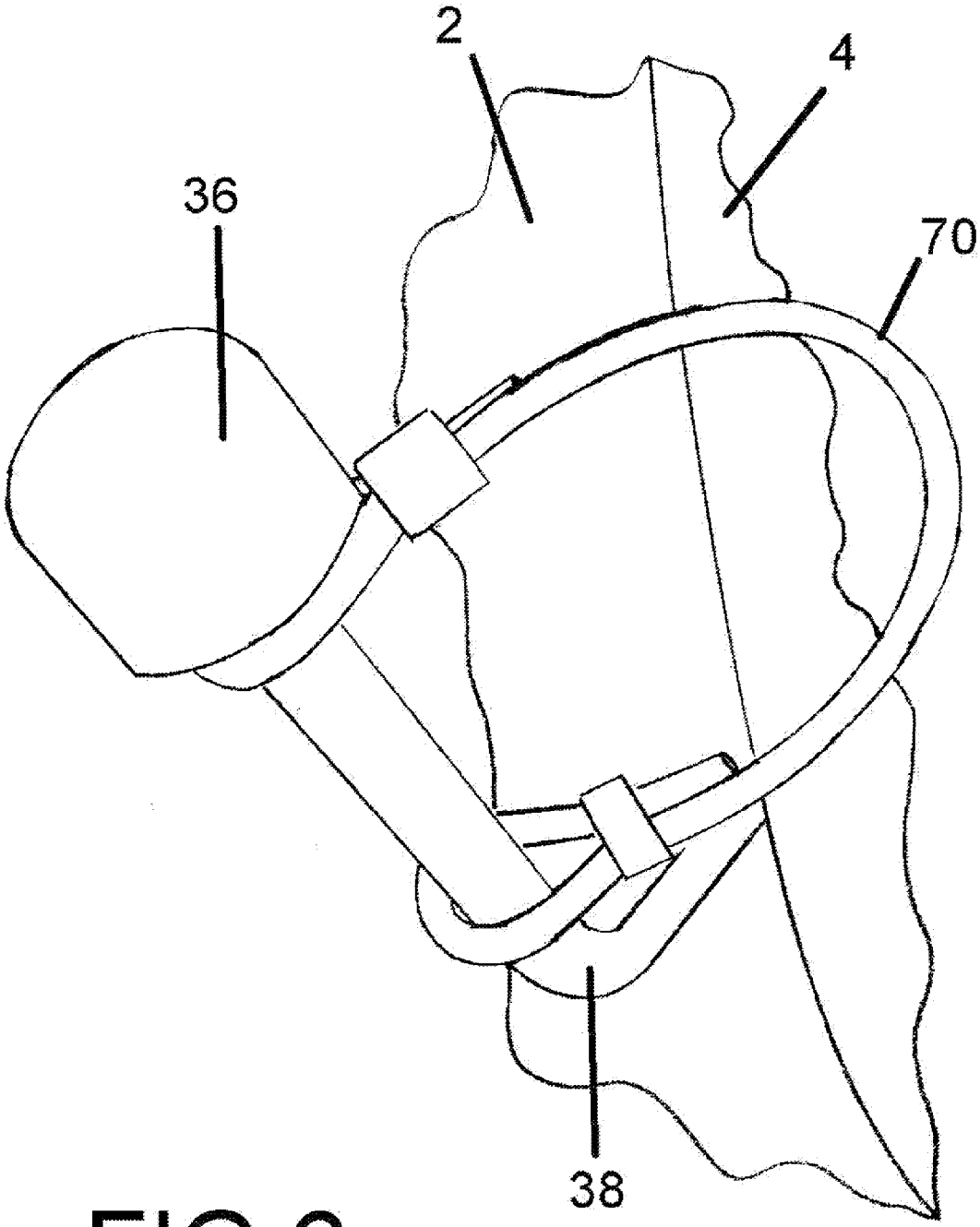
FIG. 6 shows the use of a strap attached to the bidet hoop conduit lever arm so that the bidet hoop conduit can be more easily manipulated by a user who may be handicapped or may not have normal hand strength.

It is thus apparent that complete operation of the bidet device 10 is achieved by the one action of manipulating the handle 36 or lever arm 38, and it is not necessary to activate different mechanism for rotating the bidet hoop conduit 20 into the operative position and to open or close flow through the nozzle 30. This simple one handed actuation is especially desirable when the bidet device 10 is operated by a person who may not have full control of the movement of his or her hands and fingers and perhaps not even of his or her arms. There is no need to use the fingers to open and close the valve, and movement of the bidet hoop conduit 20 can even be achieved without the necessity of gripping the handle 36 or the lever arm 38. For example, a user could operate this bidet device 10 by crooking his or her wrist around the lever arm 38 to pull it upward to move the bidet hoop conduit 20 and the nozzle 10 to their operative positions. Disengagement of the wrist, hand or arm will then allow the bidet hoop conduit 20 to return to the fully retracted position, merely by the action of the coil spring 28. This bidet device 10 will therefore be especially suited for use by the handicapped or the elderly or by other users, whose freedom of action and/or strength is limited. FIG. 6 shows a further modification to the bidet device 10 which will make it even easier for operation by a person with limited dexterity. A loop or strap 70 extends from the lever arm section of the bidet hoop conduit 20. A person who cannot grip or manipulate either the handle 38 or the lever arm 38 may find it easier to insert his or her hand, arm or wrist through this strap 70 and pull upward to activate the bidet device 10. This strap or loop 70 can be added to the bidet device 10 or it can be permanently attached to the bidet hoop conduit 20 replacing the handle 36. These and other modifications would be apparent to one of ordinary skill in the art, and this invention is not limited to the representative embodiment depicted herein, but is instead defined by the following claims consistent with a reasonable interpretation thereof.

I claim:

1. A bidet device attachable to a toilet seat, the bidet device comprising:

a valve connectable to a water supply conduit and to a bidet hoop conduit, rotation of the valve with the bidet hoop conduit opening the valve to supply water through the bidet hoop conduit;

a nozzle on the bidet hoop conduit;

an exposed, manipulatable portion of the bidet hoop conduit extending beyond on an opposite end of the bidet hoop conduit from the valve, movement of the exposed, manipulatable portion moving the bidet hoop conduit from a retracted to an operative position in which the nozzle is positioned at a central location, spaced from the toilet seat;

a stationary arm securable to the toilet seat beside the valve;

the bidet device including an actuator on the valve, engagement of the actuator with the stationary arm opening the valve, wherein the actuator includes an arcuate notch through which the stationary arm extends, the actuator being initially rotatable with the bidet hoop conduit prior to opening of the valve and engaging the stationary arm as the bidet hoop conduit approaches the operative position to initiate water flow through the bidet hoop conduit and the nozzle only when the nozzle approaches the operative position.

2. The bidet device of claim 1 wherein the arcuate notch forms an included angle so that water begins to flow through the bidet hoop conduit and the nozzle after the exposed manipulatable portion has rotated through an arc equal to the included angle formed by the notch.

3. The bidet device of claim 2 wherein the included angle formed by the notch is ninety degrees.

4. The bidet device of claim 1 wherein the actuator comprises a disk and the arcuate notch is formed by two spaced apart notch surfaces extending at an angle relative to each other.

5. The bidet device of claim 4 wherein the disk is attached to a valve stem that is rotatable away from a valve seat to open the valve and allow water to pass to the bidet hoop conduit and the nozzle.

6. The bidet device of claim 5 wherein the valve stem begins to rotate relative to the valve seat only after one of the notch surfaces engages the stationary arm as the bidet hoop conduit and the nozzle approach the operative position.

7. The bidet device of claim 6 wherein the valve seat is attachable to the water supply conduit.

8. The bidet device of claim 7 wherein the bidet hoop conduit is spring loaded relative to the valve seat to close the valve seat after release of the bidet hoop conduit.

9. The bidet device of claim 1 wherein the valve after being open closes only as the bidet hoop conduit and the nozzle approach the retracted position.

10. The bidet device of claim 1 wherein the exposed, manipulatable portion comprises a handle and a lever and rotation of the handle imparts both rotation of the bidet hoop conduit to the operative position and valve opening so that the bidet device can be activated with one hand.

11. A bidet device in which the bidet device can be moved to an operative position and flow of water through the bidet device can be activated by a single operable member moveable by one user appendage and in which initial water flow through the bidet device occurs only when the bidet device is in or adjacent to the operative position but not in or adjacent to a retracted position, the bidet device comprising:

a bidet hoop conduit movable from the retracted position below a toilet seat to the operative position spaced from and centered relative to the toilet seat;

a stationary member attachable to a toilet seat;

a valve mounted on the bidet hoop conduit, the valve being opened by rotation of a valve actuator upon engagement with the stationary member, the valve actuator not engaging the stationary member during most but not all of the rotation of the bidet hoop conduit between the retracted and the operative positions so that the valve is opened as the bidet hoop conduit is in or adjacent to the operative position;

wherein the valve closes only as the bidet hoop conduit returns toward the retracted position.

12. The bidet device of claim 11 wherein the actuator engages a first surface of the stationary member as the bidet hoop conduit approaches the operative position and the actuator engages an opposite second surface as the bidet hoop conduit approaches the retracted position.

13. The bidet device of claim 11 wherein the bidet hoop conduit continues to move to the operative position after the actuator engages the stationary member so that the valve continues to open until the bidet hoop conduit reaches the operative position.

14. A bidet device mountable on a toilet, the bidet device comprising:

a toilet seat mountable on the toilet;

a bidet hoop conduit mounted on an underside of the toilet seat;

a valve mounted on one end of the bidet hoop conduit;

an operable member on an opposite end of the bidet hoop conduit, the bidet hoop conduit being rotatable from a retracted position to an operative position by movement of the operative member;

wherein the valve on the bidet device is shifted from a closed position to an open position only after the bidet hoop conduit approaches is in or adjacent to the operative position and is shifted from the open to the closed position as the bidet hoop conduit approaches is in or adjacent to the retracted position; and wherein a stationary member is mounted to the toilet seat and engagable by a valve actuator only during a portion of the rotation of the bidet hoop conduit and only as the hoop conduit approaches the operative position or the retracted position; and wherein the bidet device is operable by one hand only.

15. The bidet device of claim 14 wherein the valve actuator is mounted on a rotatable valve stem, the valve actuator including a notch defined by opposite notch surfaces extending at an included angle relative to each other, the opposite notch surfaces engaging the stationary member only as the hoop conduit approaches the operative position or the retracted position.

16. The bidet device of claim 15 wherein the valve is opened only as the bidet hoop conduit approaches the operative position, but flow through the valve and through a nozzle on the bidet hoop conduit continues as the bidet hoop conduit moves from the operative position to the retracted position.

* * * * *